United States Patent [19]

Rosquist

[11] 4,333,430

[45] Jun. 8, 1982

[54] ENGINE BRAKE

[76] Inventor: Von D. Rosquist, P.O. Box 161, Levan, Utah 84639

[21] Appl. No.: 48,988

[22] Filed: Jun. 15, 1979

[51] Int. Cl.[3] ..... F02D 9/06

[52] U.S. Cl. ..... 123/321; 123/90.16; 123/323

[58] Field of Search ..... 123/320, 321, 322, 323, 123/345, 347, 90.12, 90.13, 90.16

[56] References Cited

U.S. PATENT DOCUMENTS

| | | | |
|---|---|---|---|
| 1,797,105 | 3/1931 | Shablom | 123/321 |
| 3,403,663 | 10/1968 | Wagner | 123/90.16 |
| 3,786,792 | 1/1974 | Pelizzoni et al. | 123/321 |
| 4,133,332 | 1/1979 | Benson et al. | 123/90.16 X |
| 4,174,687 | 11/1979 | Fohrmann | 123/321 X |

*Primary Examiner*—Tony M. Argenbright

[57] ABSTRACT

An engine retarder brake for operating a valve in the combustion chamber of an internal combustion engine near the end of the exhaust stroke to thereby discharge compressed air and cause the engine to operate as a brake for the vehicle.

7 Claims, 6 Drawing Figures

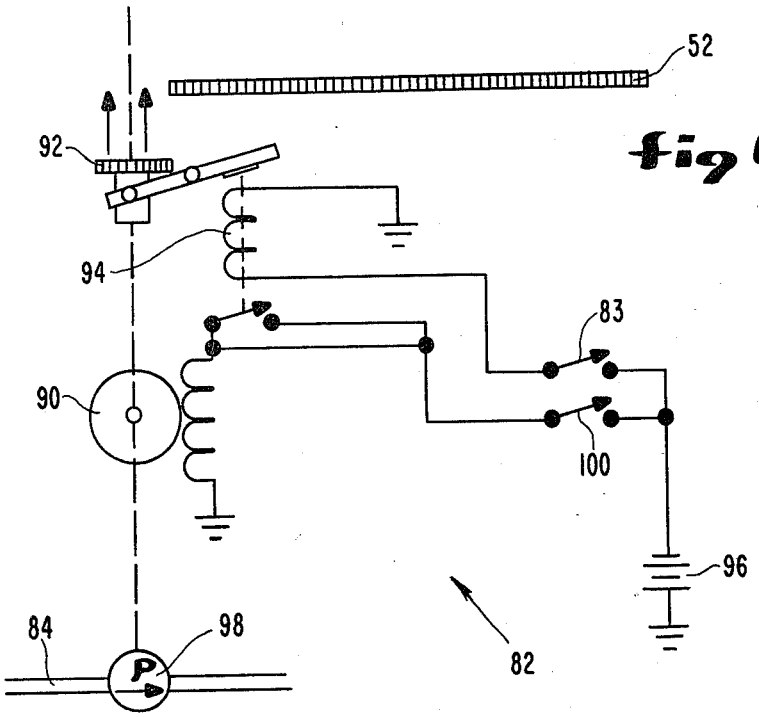
fig 6
fig 5
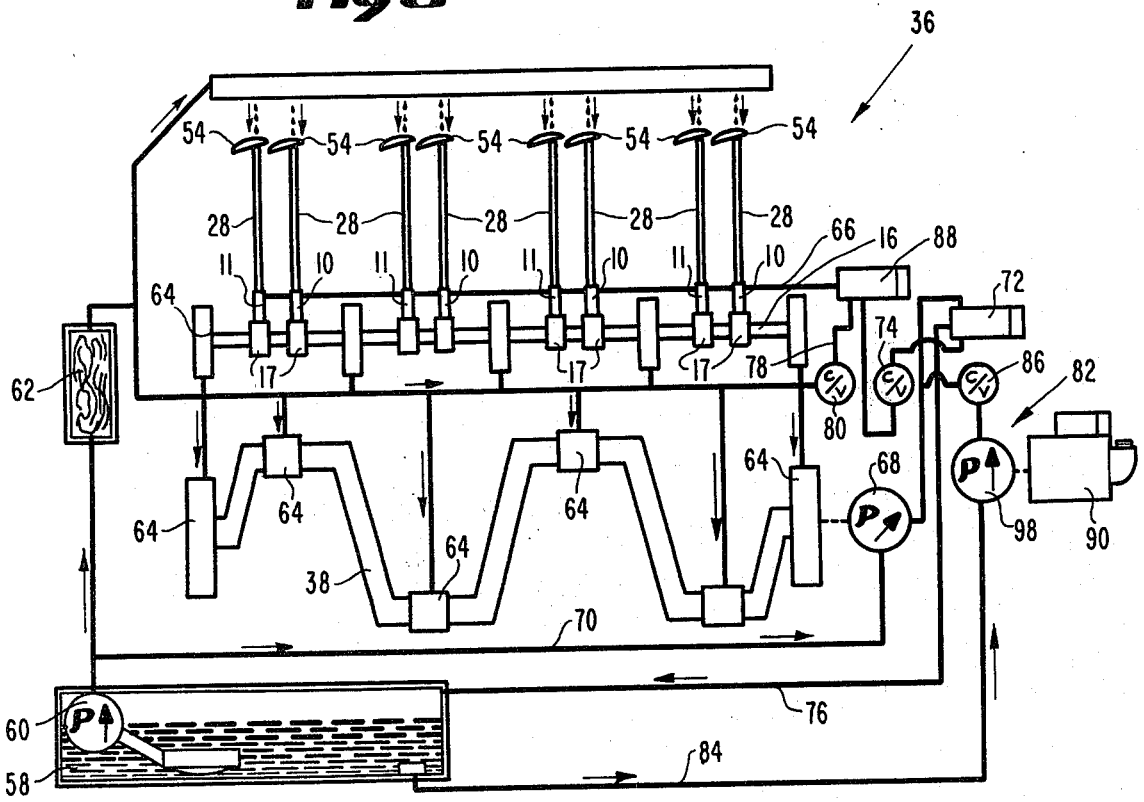

ENGINE BRAKE

SUMMARY OF THE INVENTION

This invention relates to an engine retarder brake for internal combustion engines, such as two and four cycle gasoline or diesel engines, of the class characterized as having a valve in a combustion chamber, a cam shaft, and a valve operating mechanism connecting the cam shaft and valve.

Internal combustion engines are used extensively to supply the motive power required by load-carrying vehicles, such as highway trucks. The massive loads carried by these vehicles and the weight of the vehicles themselves combine to require a substantial braking effort to slow these vehicles and to dissipate the kinetic energy of the moving load and vehicle. Particularly when operating in mountainous terrain the brakes of these vehicles are taxed. In descending an incline, the kinetic energy resulting from the descent must be controlled in addition to the kinetic energy of the moving vehicle. Failure to control these energies frequently results in run-away trucks and highway accidents. Consequently, it is desirable and common to provide supplemental brakes on these vehicles in addition to the usual chassis brakes acting at the wheels. Such supplemental brakes frequently employ the vehicle engine by modifying its power-producing operation to result in the engine operating as an energy dissipator for braking the vehicle through its mechanical link to its driven wheels.

These operation-modifying engine brakes are the subject of many patents and in general may be classified as being of two types. The first type introduces an apparatus into the exhaust stream of the engine which increases the resistance to the flow of exhaust gases, usually between the exhaust manifold and exhaust pipe. This apparatus causes the engine to operate as a pump, moving fluid against a high resistance. The pumping losses associated with such a pump dissipate vehicle energy. This first class of apparatus suffers from a lack of reliability, a less than optimum vehicle retarding effect, and a requirement for frequent maintenance. Such apparatus is operated in the high temperature, corrosive exhaust gases of an engine and is difficult to maintain in good operating condition. Additionally, the high exhaust manifold pressures resulting from such use frequently cause breeched exhaust manifold gaskets and thereby cause additional vehicle down-time. The second type of engine brake utilizes a hydraulic actuator in association with the exhaust valve of the engine. A hydraulic pump in association with the engine cam shaft causes the actuator to open the exhaust valve in response to cam shaft rotation near the completion of the compression stroke. The air compressed within the combustion chamber is thus vented into the exhaust manifold and the energy requirement associated with compressing the air dissipates vehicle energy. This second type of engine brake involves a considerable modification of usual engine construction, is expensive, and increases maintenance time requirements by adding to the complexity of the engine.

In the engine brake of this invention, a hydraulic actuator is introduced into the valve operating mechanism between the cam shaft and the exhaust valve. A pressurized fluid is supplied to the actuator to pressurize a chamber therein and to hold the actuator in a normally extended position during engine operation as a power producer. Thus, the engine exhaust valve is operated through the actuator and valve mechanism in response to cam shaft rotation. Interruption of the pressurized fluid supply to the actuator causes it to collapse and to, therefore, only partially open the exhaust valve during the exhaust stroke of the engine. The exhaust valve opening occurs during the latter part of the exhaust stroke after the piston has partially compressed the gases in the combustion chamber. Compressed gases are vented into the exhaust manifold and thereby dissipate vehicle energy. Exhaust manifold pressures are not increased by this invention and engine complexity is only slightly increased. Maintenance requirements for an engine with this brake are minimal when compared to the requirements of an engine with the prior art types of engine brakes above described.

Accordingly, it is an object of this invention to provide an engine brake for internal combustion engines.

Another object is to provide an engine brake which operates in conjunction with the exhaust valve of an engine.

Another object is to provide an engine brake which is simple and reliable.

Another object is to provide an engine brake that is economical and effective.

Other objects will be apparent from a reading of the following specification.

BRIEF DESCRIPTION OF THE DRAWINGS

FIG. 5 is a schematic illustration of the oil supply and circulation system of an engine with the brake installed therein.

FIG. 6 is a schematic illustration of an auxilliary fluid pump of the brake.

DESCRIPTION OF THE PREFERRED EMBODIMENT

Figures 1, 2, 3, 4:
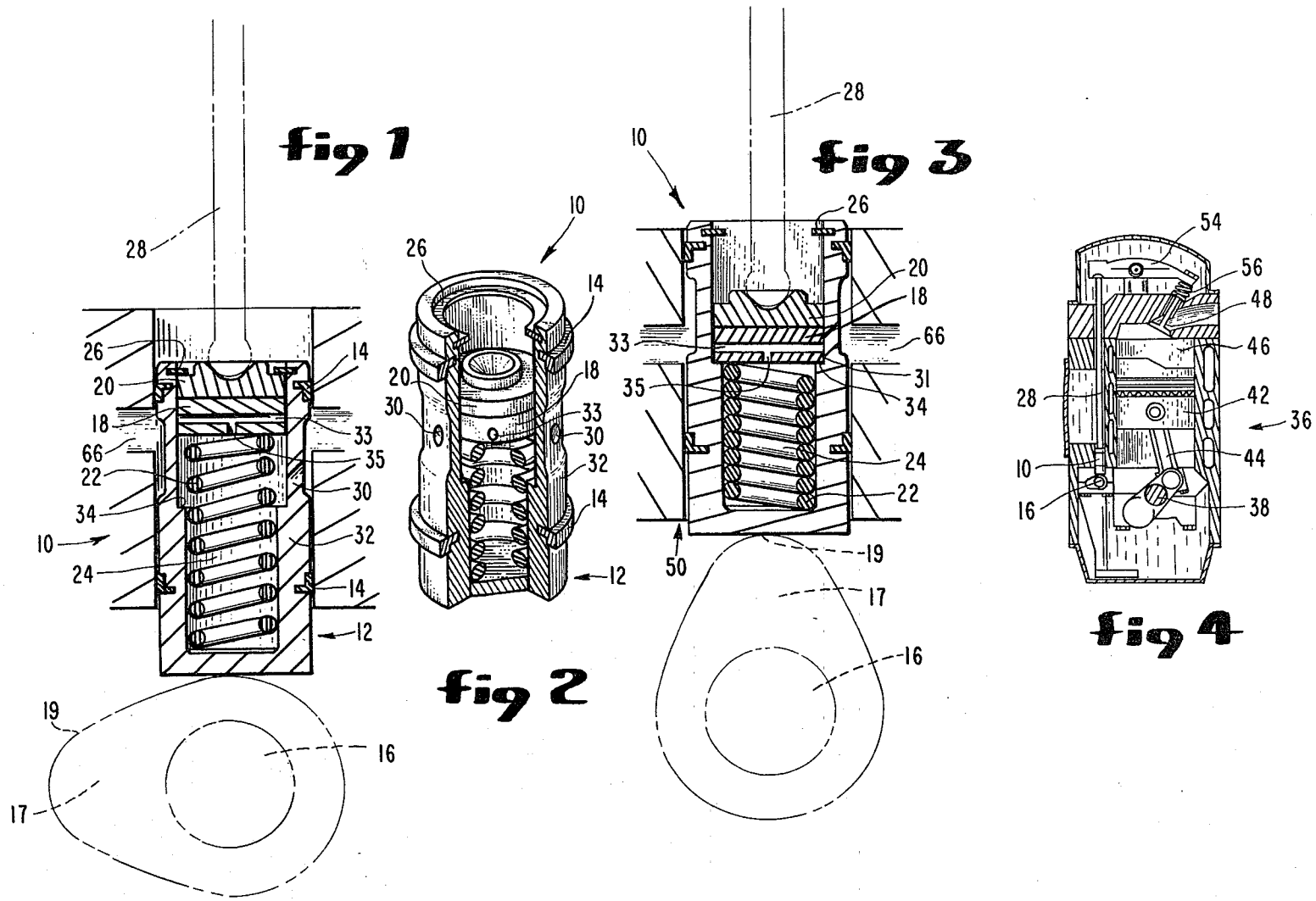
FIG. 1 is a sectional elevation view of the engine brake in association with the cam shaft and push rod (shown in phantom lines) of an engine.
FIG. 2 is a perspective view of the engine brake with parts broken away for purposes of illustration.
FIG. 3 is a sectional elevational view of the engine brake in its collapsed position.
FIG. 4 is a sectioned elevational view of a typical engine taken at one cylinder.

The preferred embodiment illustrated is not intended to be exhaustive or to limit the invention to the precise form disclosed. It is chosen and described to illustrate the principles, application, and practical use of the invention to therey better enable others skilled in the art to utilize the invention. Such preferred embodiment is illustrated in FIGS. 1–6.

With reference to FIG. 1, the engine brake includes an actuator 10 having a housing 12 carrying ring seals 14. Housing 12 is slidingly received into a bore of engine 36 (shown in FIG. 4) and is contacted by the engine cam shaft 16. A valve cap 18, top cap 20, and spring 22 are slidingly located within housing 12. Top cap 20, valve cap 18, and housing 12 define a hydraulic actuator chamber 24 within actuator 10. Spring 22 urges caps 18 and 20 into a normally extended position against a retainer ring 26. Actuator 10 is in contact with an engine push rod 28 which is part of the valve operating mechanism of internal combustion engine 36. One or more holes 30 extend through the side wall 32 of housing 12 into chamber 24. An internal annular shoulder 34 is formed in side wall 32 and is located below valve cap 18.

FIG. 4 illustrates internal combustion engine 36 in section and in a typical form. Engine 36 includes a crank shaft 38 and cam shaft 16 which rotate in a fixed relation to each other. A piston 42 is connected to crank shaft 38 by a connecting rod 44 and reciprocates in combustion chamber 46. A valve 48 is located in chamber 46 and is opened in response of cam shaft 16 by actuator 10, push rod 28 and rocker arm 54. A spring 56 urges valve 48 into a normally closed position. As can be readily seen, valve 48 is opened by longitudinal motion of actuator 10 and push rod 28. It will be understood in addition to valve 48 and its associated actuator 10 the usual engine has one or more other valves in each combustion chamber and that they will be adapted for air intake and for exhaust of combustion gases.

Spring 22 within actuator 10 is not of sufficient strength to overcome spring 56 and open valve 48 in response to cam shaft rotation. Actuator 10 is supplied with a pressurized fluid at side wall 32 between seals 14. The fluid is admitted to chamber 24 of the actuator through hole 30 and applies an additional force to caps 18 and 20 to keep the actuator in its normal extended position shown in FIG. 1. The combined fluid pressure and bias from spring 22 is sufficient to overcome spring 56 and to open valve 48 in response to the rotation of cam shaft 16. Thus top cap 20 is in contact with ring 26 as valve 48 is opened and closed in response to cam shaft rotation.

Interruption of the pressurized fluid into actuator chamber 24 results in a lessening of the force against caps 18 and 20 to allow actuator 10 to shift into its collapsed position between push rod 28 and cam lobe 17 as cam shaft 16 is rotated by crank shaft 38.

Rotation of cam shaft 16 causes housing 12 to slide upward, as illustrated in FIG. 3 by the arrow 50, while cap parts 18 and 20 slide within actuator chamber 24 toward shoulder 34 therein. Valve cap 18 preferably rests against shoulder 34 when actuator 10 is in its collapsed position. The lower edge 31 of hole 30 is above shoulder 34 and causes the remaining, unvented fluid within chamber 24 to act as a cushion and to minimize the impact of cap 18 contacting shoulder 34.

FIG. 2 shows valve cap 18 and top cap 20 in a position spacedly between ring 26 and shoulder 34 of actuator 10. Lubrication of the surfaces of valve cap 18 and top cap 20 which are in sliding contact with the side wall 32 of actuator housing 12 is provided through passages 33 in valve cap 18 which communicate with the pressurized oil in chamber 24 through a hole 35 seen in FIGS. 1 and 3.

The difference in length of actuator 10 between its normal and collapsed positions is chosen to be less than the height of cam lobe 17. Thus, valve 48 will be opened by cam shaft 16 through actuator 10 only near the peak 19 of lobe 17. This opening of valve 48 will occur later in the exhaust stroke of engine 36 then is normal when the engine is operating as a power producer and will be less than the normal full open position of the valve which occurs when actuator 10 is in its extended position. Piston 42 will have advanced considerably into chamber 46 and will have compressed the gases therein before valve 48 is opened.

With reference now to FIG. 5, one embodiment of a system for supplying pressurized fluid to each actuator 10 is schematically shown. The engine 36 is illustrated as having four cylinders and includes an oil pan 58 containing a lubricating oil. An oil pump 60 is driven from crank shaft 38 and circulates oil through filter 62 and to the various bearings 64 of the engine, to rocker arms 54, and to a conduit 66 which is in communication with the actuators 10 and the intake valve lifters 11 associated with cam shaft 16 and with push rods 28 (the engine valves, pistons, and connecting rods are not shown). A second pump 68 is driven by engine 36 and is supplied with oil through conduit 70. Pump 68 supplies oil to conduit 66 through solenoid valve 72 and check valve 74 at a pressure preferably above the normal lubricating oil pressure of engine 36. The pressurized oil from pump 68 is at a pressure great enough to insure that the actuators 10 are maintained in their normal extended positions during operation of engine 36 as a power producer. Solenoid 72 may be controlled by the vehicle driver to interrupt the flow of oil from pump 68 to conduit 66 and to divert this flow through conduit 76 back to oil pan 58. Interruption of the oil flow from pump 68 allows actuators 10 to collapse and to cause engine 36 to operate as an energy dissipator. Conduit 66 normally will be supplied with oil from pump 60 through conduit 78 and check valve 80. This oil flow insures continued lubrication of all moving parts of the engine but is preferably of insufficient pressure to extend actuators 10 to normal position.

A motor-driven pump unit 82 including pump 98 and motor 90 draws oil from oil pan 58 through conduit 84 and supplies pressurized oil to conduit 66 through check valve 86, solenoid valve 72, and check valve 74. Pump 82 is employed to pressurize conduit 66 and to shift actuators 10 into their normal positions when engine 36 is to be started after a period of inoperation. A solenoid valve 88 is employed to close off the entrance to conduit 66 when engine 36 is not in operation. Valve 88 prevents the oil from draining from conduit 66 and results in a reduced requirement for fluid flow to pressurize conduit 66 and to extend actuators 10 when engine 36 is to be started.

FIG. 6 illustrates one embodiment of motor-driven pump 82. Motor-pump unit 82 replaces the standard electric starter motor of engine 36 and includes a motor 90 and pinion gear 92. Gear 92 is shifted, as shown by arrows 93, by an electro-mechanical solenoid 94 to a position of engagement with the ring gear 52 of engine 36 which is attached to a fly wheel carried by crank shaft 38. Activation of solenoid 94 by closing switch 83 engages gear 92 with gear 52 and connects motor 90 to the vehicle's storage battery 96, causing motor 90 to turn crank shaft 38 and pump 98. Pump 98 is connected to conduit 84 and to check valve 86. A switch 100 connects motor 90 to battery 96 without actuating solenoid 94. Thus, motor 90 can be employed to drive pump 98, thereby pressurizing conduit 66 and extending or shifting actuators 10 into their normal extended positions without turning crank shaft 38. A pressure gauge (not shown) will ordinarily be employed to indicate to the vehicle driver that a sufficient pressure has been attained in conduit 66 and that he may start the engine by closing switch 83 and actuating solenoid 94.

It is to be understood that this invention is not to be limited to the precise form disclosed, but that it may be modified within the scope of the appended claims.

What I claim is:

1. In an engine brake for use with an internal combustion engine having an engine block, a cam shaft, a combustion chamber, a valve in said combustion chamber, a valve operating mechanism between said cam shaft and said valve for operating said valve in response to rotation of said cam shaft, said valve operating mechanism including an actuator, said actuator having a normal extended position in which said valve normally opens and closes during engine operation and a collapsed position in which said valve is only partially opened, means for supplying a pressurized fluid to said actuator to shift said actuator between its normal extended and collapsed positions, whereby said actuator when in its normal extended position opens and closes said valve in response to cam shaft rotation and said engine operates as a power producer and when in its collapsed position said valve is only partially opened by said actuator and said engine operates as an energy dissipator for braking purposes, a fluid pump driven by an electric motor, said pump for delivering pressurized fluid to said actuator, the improvement wherein:

said electric motor includes a pinion gear adapted to engage an engine flywheel ring gear, means for engaging said pinion gear with said ring gear, and means for electrically connecting said motor to the storage battery of a vehicle, whereby said motor may be employed to drive said pump while driving said pinion gear in engagement with said engine flywheel ring gear.

2. In an engine brake for use with an internal combustion engine having a cam shaft, a combustion chamber having an end, a piston shiftable within said combustion chamber toward and away from said chamber end, a valve in said combustion chamber associated with said chamber end, a valve operating mechanism between said cam shaft and said valve for opening and closing said valve in response to rotation of said cam shaft, the improvement therein comprising:

said valve operating mechanism including collapsible actuator means for varying the opening and closing movement of said valve, said actuator means having a normal extended position in which said valve normally opens and closes upon cam shaft rotation during power providing engine operation to allow the venting of exhaust gases from said combustion chamber as said piston shifts toward and away from the chamber end, said actuator means having a collapsed position in which said valve opens and closes during deceleration of said engine as said piston shifts into its closest position to said combustion chamber end to allow compression of the exhaust gases within said combustion chamber for engine braking purposes, and means for supplying a pressurized fluid to said actuator means to move the actuator means into its normal extended position during power providing operation of said engine and for releasing said fluid from said actuator means to permit the actuator means to move into its collapsed position during periods of deceleration of said engine.

3. The engine brake of claim 1 wherein said actuator means includes an actuator housing defining a chamber therein, a cap member slidingly positionable within said housing chamber between a first location in which said actuator means is in its said normal extended position and a second location in which the actuator means is in its said collapsed position, said housing and cap member defining said chamber, said valve mechanism including a push means associated with said valve for operating said valve, said push means supported for valve operating movement by said cap member.

4. The engine brake of claim 3 wherein said actuator chamber includes a resilient spring means for urging said cap member to its said first location.

5. The engine brake of claim 2 wherein said means for supplying a pressurized fluid to said actuator means includes a fluid pump, a valve means for interrupting the fluid flow from said pump, means in association with said valve means for operating said valve means, said pump and said valve means being in fluid flow communication with said actuator means whereby said pressurized fluid may be supplied to and diverted from said actuator as caused by said valve means.

6. The engine brake of claim 2 wherein said means for supplying pressurized fluid to said actuator means includes a valve means for preventing the drainage of fluid from said actuator means when said engine is not in operation.

7. A method of utilizing an internal combustion engine for braking forward movement of a vehicle carrying said engine comprising the steps of:

a. providing an expandable and contractable valve means between the cam shaft of said engine and the exhaust valves of the engine for regulating opening and closing movement of the valves upon valve means actuation, b. actuating said valve means during engine operation in powering said vehicle to place the valve means in said expanded position and to cause said valves to normally open and close, and c. actuating said valve means during deceleration of said engine to place the valve means in said collapsed position and to cause said valves to open and close only as the pistons in said engine are being further advanced into the engine cylinders to allow compression of the exhaust gases therein with resulting engine braking.

* * * * *